US008364055B2

(12) United States Patent
Ashida et al.

(10) Patent No.: US 8,364,055 B2
(45) Date of Patent: Jan. 29, 2013

(54) IMAGE FORMING APPARATUS

(75) Inventors: Kenichi Ashida, Toyohashi (JP); Takuji Yamamoto, Toyokawa (JP); Hideaki Ikeda, Toyokawa (JP); Shinji Yanase, Shinshiro (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 165 days.

(21) Appl. No.: 12/822,279

(22) Filed: Jun. 24, 2010

(65) Prior Publication Data

US 2010/0329727 A1 Dec. 30, 2010

(30) Foreign Application Priority Data

Jun. 30, 2009 (JP) ..... 2009-155373

(51) Int. Cl.
*G03G 21/00* (2006.01)

(52) U.S. Cl. ..... 399/98

(58) Field of Classification Search ..... 399/98, 399/118, 123
See application file for complete search history.

(56) References Cited

U.S. PATENT DOCUMENTS

| | | | |
|---|---|---|---|
| 7,898,559 | B2 | 3/2011 | Kobayashi |
| 2008/0205951 | A1 | 8/2008 | Ueda et al. |

FOREIGN PATENT DOCUMENTS

| | | |
|---|---|---|
| JP | 09-160470 | 6/1997 |
| JP | 2001-343876 | 12/2001 |
| JP | 2007-072321 A | 3/2007 |
| JP | 2007-206579 | 8/2007 |
| JP | 2008-242432 | 10/2008 |

OTHER PUBLICATIONS

Office Action (Notification of Reasons for Refusal) dated Apr. 26, 2011, issued in the corresponding Japanese Patent Application No. 2009-155373, and an English Translation thereof.

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An image forming apparatus having a cleaner for cleaning a surface of a dust-proof glass disposed on a housing of a laser scanning unit for irradiating a photosensitive member with a laser modulated in accordance with image data. The cleaner is supported by a frame of the image forming apparatus body such that the cleaner is movable while keeping in contact with the dust-proof glass and such that the cleaner stays in a stand-by position while keeping out of contact with the dust-proof glass and the housing of the laser scanning unit.

2 Claims, 4 Drawing Sheets

IMAGE FORMING APPARATUS

This application is based on Japanese patent application No. 2009-155373 filed on Jun. 30, 2009, of which content is incorporated herein by reference.

BACKGROUND OF THE INVENTION

1. Field of the Invention

The present invention relates to an image forming apparatus, and more particularly to an image forming apparatus, such as an electrophotographic copying machine, comprising a laser scanning unit.

2. Description of Related Art

Image forming apparatuses, such as electrophotograhic copying machines and printers, generally comprise a laser scanning unit for illuminating a photosensitive member with a laser modulated in accordance with image data. In such a laser scanning unit, a dust-poof glass is provided to a radiation window so that toner and dust particles suspended in the air inside a machine will not enter into the unit. However, it is likely that these particles stick to the surface of the dust-proof glass, and in this case, the picture quality of a formed image is lowered (white stripes are seen in a formed image). Especially when the laser scanning unit is located under a processing unit including a photosensitive member, the trouble caused by the adherence of particles to the dust-proof glass is notable.

In order to avoid the trouble, conventionally, Japanese Patent Laid-Open Publication No. 2007-72321 suggests that a cleaner be provided in the laser scanning unit. Japanese Patent Laid-Open Publication No. 2007-72321 also suggests that the cleaner be kept out of contact with the dust-proof glass when the cleaner is in a stand-by position, while the cleaner be moved to clean the surface of the dust-proof glass at desired times. However, when the cleaner is supported by a housing of the laser scanning unit, even if the cleaner is kept out of contact with the dust-proof glass, the housing of the laser scanning unit may be deformed by the load of the cleaner, which may cause a problem that the optical characteristics of laser radiation are lowered.

SUMMARY OF THE INVENTION

An object of the present invention is to provide an image forming apparatus wherein a housing of a laser scanning unit is not influenced by the load of a cleaner for cleaning a dust-proof glass.

According to an aspect of the present invention, an image forming apparatus comprises a cleaner for cleaning a surface of a dust-proof glass disposed on a housing of a laser scanning unit for irradiating a photosensitive member with a laser modulated in accordance with image data, and the cleaner is supported by a frame of a body of the image forming apparatus such that the cleaner is movable while keeping in contact with the dust-proof glass and such that the cleaner stays in a stand-by position while keeping out of contact with the dust-proof glass and the housing of the laser scanning unit.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Figure 1:
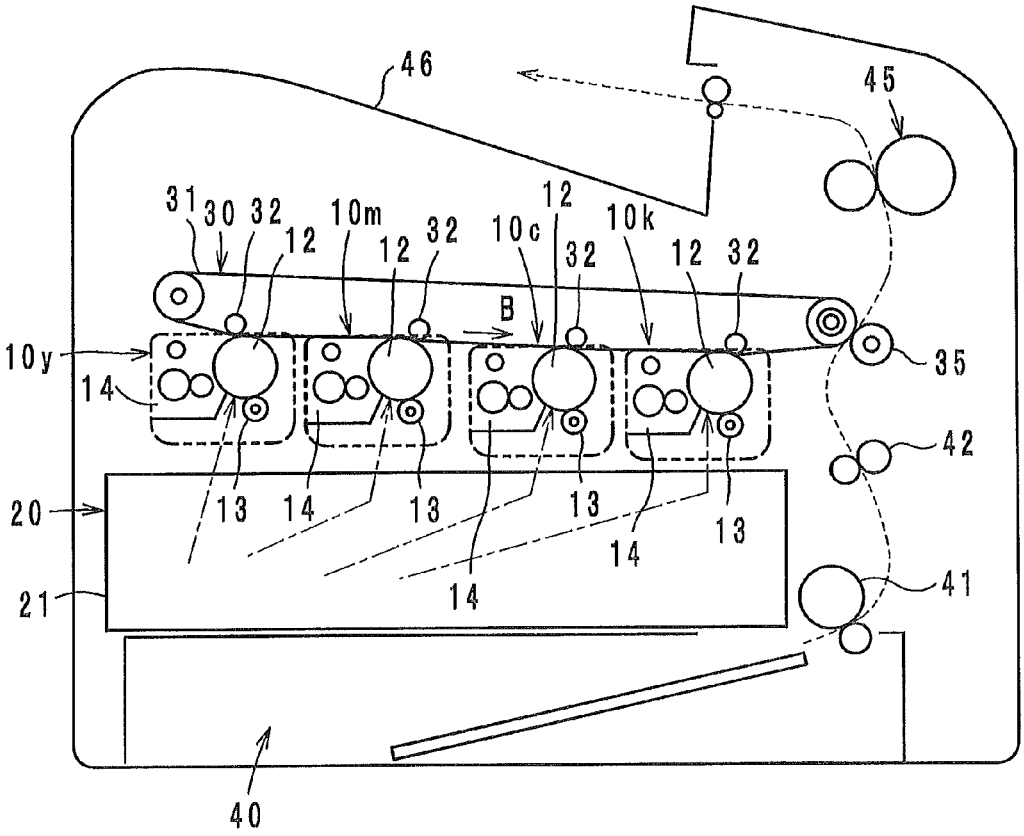
FIG. 1 is a schematic view of a printer that is an image forming apparatus according to an embodiment of the present invention.

Referring to the drawings, some image forming apparatuses according to preferred embodiments of the present invention will be described. In the drawings, the same parts and members are provided with the same reference symbols, and repetitions of descriptions thereof are omitted.

General Structure of Image Forming Apparatus

An image forming apparatus according to an embodiment of the present invention is described with reference to FIG. 1. The image forming apparatus is a tandem type color printer. The printer mainly comprises process units 10 (10*y*, 10*m*, 10*c* and 10*k*) for forming toner images of yellow (Y), magenta (M), cyan (C) and black (K) respectively, a laser scanning unit 20 and an intermediate transfer unit 30.

Each of the process units 10 comprises, in a housing shown by the dotted line in FIG. 1, a photosensitive drum 12, a charging roller 13, a developing device 14, a residual toner/charge cleaner, etc., and is capable of sliding in a direction perpendicular to the paper surface of FIG. 1 so as to be detachable from the body of the printer. In each of the process units 10, an electrostatic latent image is formed on the photosensitive drum 12 by laser radiation from the laser scanning unit 20, and the electrostatic latent image is developed into a toner image.

The intermediate transfer unit 30 has an intermediate transfer belt 31 that is an endless belt driven to rotate in a direction "B". Electric fields are formed by transfer rollers 32 located opposite to the respective photosensitive drums 12, and thereby, the toner images formed on the photosensitive drums 12 are transferred to the intermediate transfer belt 31 and combined thereon (first transfer). Such an electrophotographic image forming process is well known, and a detailed description thereof is omitted.

An automatic sheet feed unit 40 for feeding recording sheets one by one is provided in a lower part of the printer body. Each sheet is fed from a feed roller 41 to a timing roller 42 and then, to a nip portion between the intermediate transfer belt 31 and a second transfer roller 35, where the toner image (the color composite image) is transferred to the recording sheet (second transfer). Thereafter, the recording sheet is fed to a fixing unit 45, where a heating treatment is performed, and is ejected on a tray 46 located on an upper surface of the printer body.

Laser Scanning Unit and Cleaner

Figure 2:
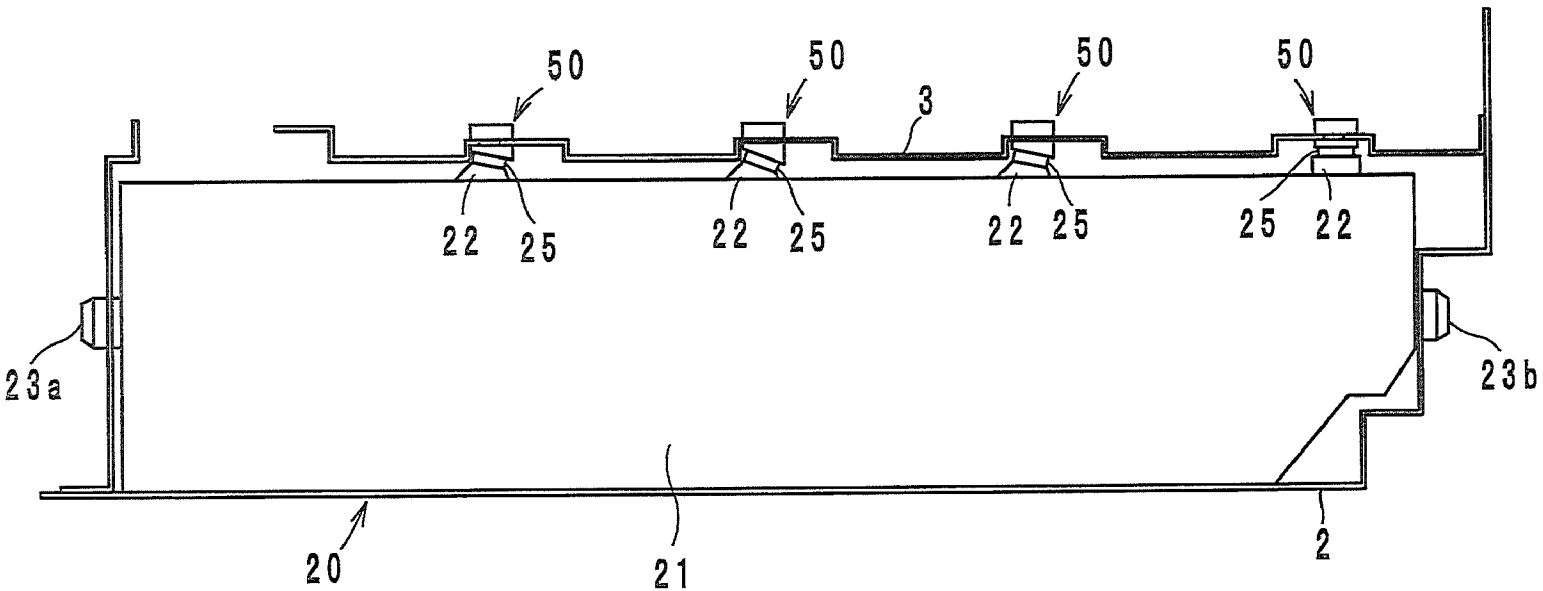
FIG. 2 is a front view of a laser scanning unit employed in the printer.

The laser scanning unit 20 is to irradiate the photosensitive drum 12 with lasers modulated in accordance with image data, and the basic structure and operation thereof are well known. Optical components, such as a light source, deflectors and lenses, are provided in a housing 21, and the laser scanning unit 21 irradiates the photosensitive drums 12 with lasers from the directions shown by the chain lines in FIG. 1. As shown by FIG. 2, the housing 21 is positioned by one projection 23*a* on the left side of a frame 2 of the printer body and two projections 23*b* on the right side of the frame 2, and is fixed in the position.

Figure 3:
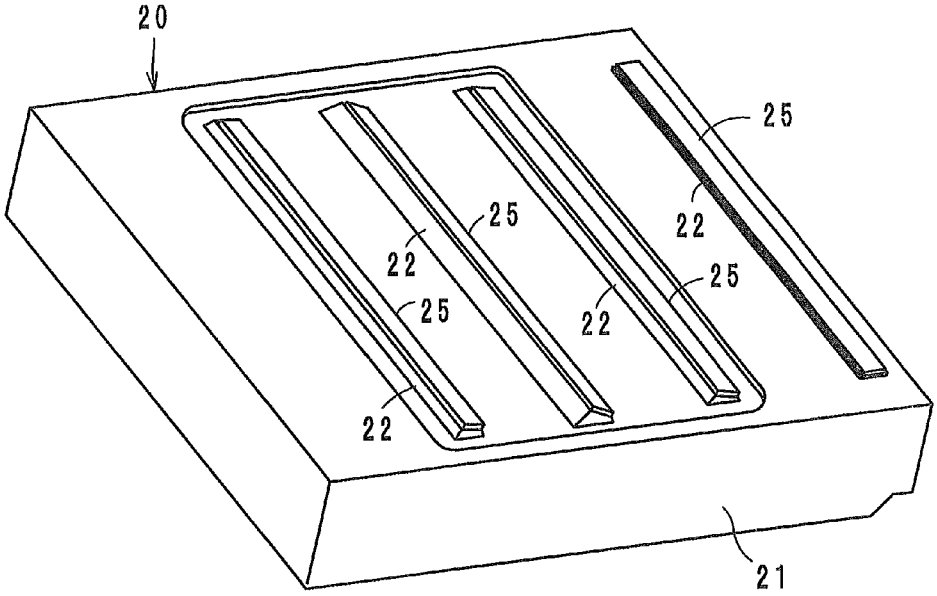
FIG. 3 is a perspective view of the laser scanning unit.

On an upper surface of the housing 21, four bases 22 are provided around four windows through which lasers are radiated, and four dust-proof glasses 25 are disposed on the bases 22 (see FIGS. 2 and 3). Cleaners 50 for wiping dust from the surfaces of the dust-proof glasses 25 are fitted to a frame 3 of the printer body.

Figure 4:
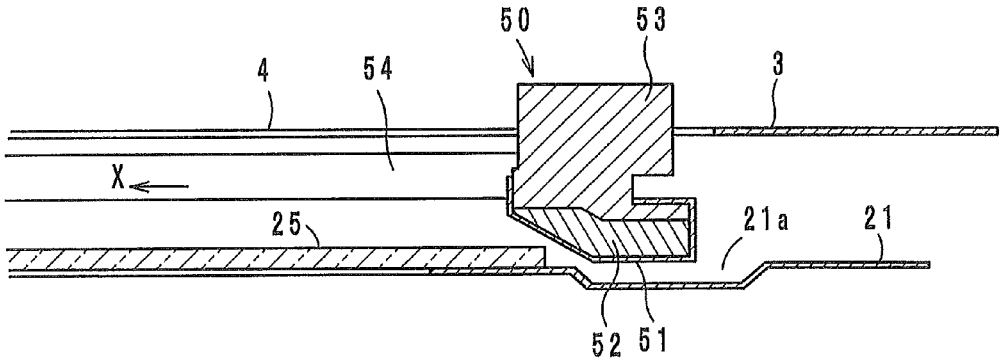
FIG. 4 is a sectional view showing a stand-by position of a cleaner for cleaning a dust-proof glass.
Figure 6:
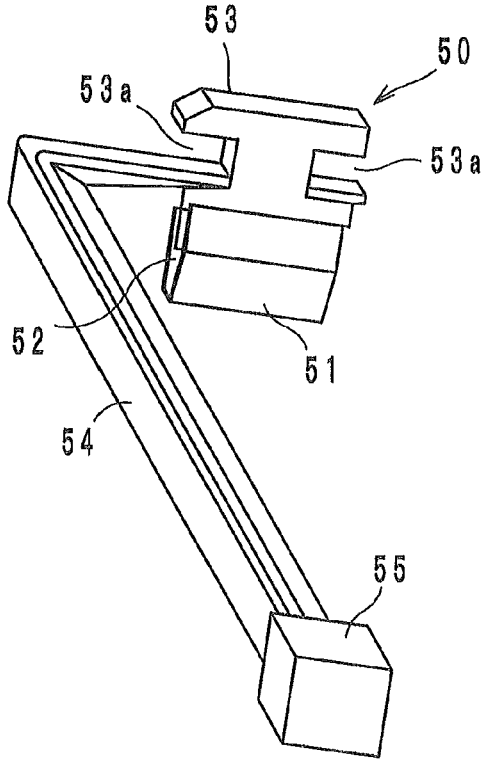
FIG. 6 is a perspective view of the cleaner.

As shown by FIGS. 4 and 6, each of the cleaners 50 comprises a cleaning pad 51 of nonwoven cloth, felt or the like, an elastic member 52 of, e.g., polyester polyurethane foam located inside the cleaning pad 51, a holder 53 for holding the cleaning pad 51, an arm 54 extending from the holder 53, and a handle 55 provided at the tip of the arm 54.

Figure 5:
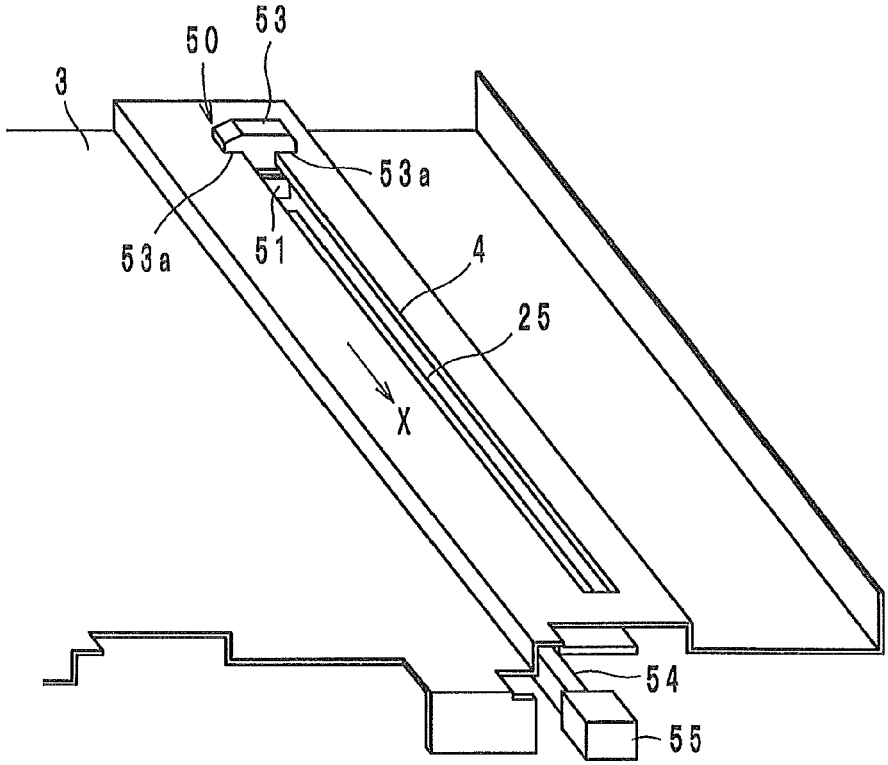
FIG. 5 is a perspective view showing installation structure of the cleaner.

As shown by FIG. 5, slits 4 are made in the frame 3 of the printer body such that the slits 4 extend in the direction where the dust-proof glasses 25 extend, and the cleaners 50 are fitted to the frame 3 via the slits 4. Specifically, each of the cleaners 50 is fitted in the corresponding slit 4 such that a narrow portion 53*a* of the holder 53 will be in the slit 4 with the edges of the slit 4 nipped between wide portions of the holder 53 upper and lower from the narrow portion 53*a* and such that the cleaner 50 is movable in the direction "X" and in the opposite direction (see FIGS. 4 and 5). The front side in FIG. 5 is the front side of the printer body, and the cleaners 50 reciprocate between the front side and the rear side of the printer body.

Each of the cleaners 50 stands by in the rear position shown by FIG. 5. While each of the cleaners 50 is in the stand-by position, the cleaning pad 51 is positioned above a recess portion 21*a* of the housing 20 of the laser scanning unit 20 as shown by FIG. 4 and thereby is out of contact with the dust-proof glass 25 and the housing 21. When an operator pulls the handle 55 to the front, the force is transmitted via the arm 54, and the cleaning pad 51 and the holder 53 move to the front (in the direction "X"). In this moment, the cleaning pad 51 comes on the dust-proof glass 25 and wipes dust from the surface of the dust-proof glass 25. After the movement of the cleaner 50 to the front, an operator pushes the handle 55 to the rear, and thereby, the cleaner 50 is returned to the stand-by position.

Thus, by moving the cleaners 50 in the direction "X" from the respective stand-by positions (see FIGS. 4 and 5), it is possible to clean the surfaces of the dust-proof glasses 25. The cleaners 50 are supported by the frame 3 of the printer body, that is, are disposed independently of the housing 21 of the laser scanning unit 20. Additionally, while the cleaners 50 stay in the stand-by positions, the cleaners 50 are not in contact with the dust-proof glasses 25 and the housing 21. Thus, the dust-proof glasses 25 and the housing 21 never have unnecessary burden of the cleaners 50. Accordingly, it never happens that the housing 21 is deformed by the load of the cleaners 50, and there is no fear that the optical characteristics of laser radiation may be lowered by deformation of the housing 21.

When the cleaners 50 are moved to clean the dust-proof glasses 25, the handles 55 of the cleaners 50 project from the printer body to the front, and a front door (not shown) of the printer body cannot be closed completely unless the cleaners 50 is returned to the stand-by positions. In a printer, generally, execution of a printing operation is prohibited if a front door of a printer body is opened. Therefore, trouble that a printing operation is started with the cleaners not returned to the stand-by positions can be prevented.

Other Embodiments

The structures and the shapes of the details of the cleaners and the installation structure of the cleaners can be arbitrarily designed. The shape and material of the cleaning pads can be arbitrarily selected. Any material that can wipe dust particles away, as well as unwoven cloth and felt, can be used for the cleaning pads. Alternatively, the cleaning pads may be replaced with blades or brushes. The means for moving the cleaners 50 may be wires, and the cleaners may be moved electrically, for example, by using a motor as a driving source.

Although the present invention has been described in connection with the preferred embodiments, it is to be noted that various changes and modifications are possible to those who are skilled in the art.

What is claimed is:

1. An image forming apparatus comprising:

a cleaner for cleaning a surface of a dust-proof glass disposed on a housing of a laser scanning unit for irradiating a photosensitive member with a laser modulated in accordance with image data, wherein the cleaner is supported by a frame of a body of the image forming apparatus such that the cleaner is movable while keeping in contact with the dust-proof glass and such that the cleaner stays in a stand-by position while keeping out of contact with the dust-proof glass and the housing of the laser scanning unit;

wherein the stand-by position of the cleaner is in a rear side from a front side of the image forming apparatus; and wherein the cleaner has an operation arm extending to the front side of the image forming apparatus.

2. An image forming apparatus according to claim 1, wherein the cleaner has a cleaning pad of nonwoven cloth or felt.

* * * * *